United States Patent [19]

Gosschalk

[11] Patent Number: 4,553,910

[45] Date of Patent: Nov. 19, 1985

[54] PULSE DRIVEN HYDRAULIC PUMP

[75] Inventor: Terry Gosschalk, Gleniffer, Australia

[73] Assignee: Nebo Pumps Pty. Ltd., Australia

[21] Appl. No.: 522,382

[22] PCT Filed: Nov. 4, 1982

[86] PCT No.: PCT/AU82/00181

§ 371 Date: Jul. 5, 1983

§ 102(e) Date: Jul. 5, 1983

[87] PCT Pub. No.: WO83/01658

PCT Pub. Date: May 11, 1983

[30] Foreign Application Priority Data

| | | | |
|---|---|---|---|
| Nov. 4, 1981 | [AU] | Australia | PF1417 |
| Mar. 26, 1982 | [AU] | Australia | PF3324 |
| Jun. 4, 1982 | [AU] | Australia | PF4686 |
| Oct. 5, 1982 | [AU] | Australia | PF6197 |

[51] Int. Cl.[4] ..... F04B 47/08

[52] U.S. Cl. ..... 417/378; 417/588

[58] Field of Search ..... 417/377, 378, 383, 390, 417/401, 402, 385, 388

[56] References Cited

U.S. PATENT DOCUMENTS

| | | | |
|---|---|---|---|
| 1,946,723 | 2/1934 | Thompson | 417/378 |
| 2,445,205 | 7/1948 | Burn . | |
| 2,578,050 | 12/1951 | Peters | 417/402 X |
| 4,013,385 | 3/1977 | Peterson | 417/377 |
| 4,021,149 | 5/1977 | Rutenberg et al. | 417/395 |
| 4,390,236 | 6/1983 | Callicoatte | 417/390 X |

FOREIGN PATENT DOCUMENTS

| | | |
|---|---|---|
| 43780 | of 1979 | Australia . |
| 67159 | of 1981 | Australia . |
| 806941 | 12/1936 | France . |
| 1393732 | 2/1965 | France . |
| 2473643 | 7/1981 | France . |

*Primary Examiner*—Leonard E. Smith

*Attorney, Agent, or Firm*—Sughrue, Mion, Zinn, Macpeak and Seas

[57] ABSTRACT

An apparatus (3) for pumping fluid from a fluid source (5) to a predetermined location (7) remote from the fluid source. The apparatus (3) comprises an hydraulically operated pump (9) having a fluid pumping chamber and means for storing potential energy. The pump (9) is connected through a control means (19) to the predetermined location (7) upstream and to the source (5) downstream. Control means (19) is also connected to second pumping means (17) and allows spaced pulses of hydraulic pressure to flow from pumping (17) through conduit (15) to pump (9). The hydraulic pulses operate pump (9) to both draw fluid from source (5) into the pumping chamber and to store a portion of the pulse energy. In the period between pulses the stored energy is used to drive pump (9) to supply the drawn fluid to predetermined location (7) and to return a volume of hydraulic fluid equal to that of the actuating hydraulic pulse. Pump (9) may be either twin diaphragm or twin piston type, coupled in tandem; examples of both types are disclosed.

4 Claims, 10 Drawing Figures

PULSE DRIVEN HYDRAULIC PUMP

The present invention relates to a pump for pumping fluids, and an apparatus which may incorporate the pump, for pumping fluids from a reservoir to a predetermined location. In particular, the present invention relates to a pump and an apparatus for pumping water.

Generally a water pump functions by performing two operations either alternately or simultaneously. First, the water to be pumped is drawn from a water source into the water pump, and second, the water is expelled from the water pump by way of a conduit to a desired location.

With regard to the first operation, in view of atmospheric pressure and frictional resistance considerations, it is necessary to locate the pump in close proximity to the water source. As a consequence, the energy to actuate the pump has to be brought to the pump at the water source. Traditionally, this has been accomplished in the following ways:

1. Electricity is carried to the water pump, either on poles or underground. The disadvantage with this arrangement is that in many instances the water pump is remote from existing power lines and thus power lines have to be laid to the water pump. This is both inconvenient and expensive.

2. A petrol or diesel engine is positioned adjacent the water pump and the water source. The disadvantage with this arrangement is that, although the initial cost is generally lower than that required with the laying of electricity power lines, petrol or diesel engines are generally more expensive to operate due to fuel costs and are inconvenient with respect to maintenance required, pollution and noise.

3. A windmill is positioned in close proximity to the water pump and the water source. The disadvantage with this arrangement is that windmills have poor efficiency in hilly country. The reason for this is that since a water source is likely to be located in low lying areas the windmill must also be located in the low lying areas and thus would be sheltered from the wind required to operate the windmill.

4. A farm tractor is coupled to the water pump and operated to power the water pump. The disadvantage with this arrangement is that while the tractor is being used to power the water pump the tractor cannot be used for other purposes.

A so-called injector pump has been proposed to avoid the necessity to locate the water pump in close proximity to the water source. The injector pump may be located remote from the water source and connected to the water source by two conduits. One conduit delivers fluid to an injector/venturi apparatus at or in the water source and this causes fluid to be drawn into and delivered through the other conduit back to the pump outlet. The disadvantages with this arrangement are that there are practical limits with respect to the distance over which injector pumps will operate efficiently, and the energy input to operate the injector pump is high and the two conduits are necessarily large in diameter and therefore expensive.

It is an object of the present invention to provide an apparatus for pumping fluids which alleviates the disadvantages of the known apparatus described in the preceding paragraphs.

It is also an object of the invention to provide an improved hydraulically operated fluid pump which is particularly suited for use in the apparatus of the invention for pumping fuilds.

According to the present invention there is provided an apparatus for pumping fluid from a fluid source to a predetermined location, the apparatus comprising:

(a) an hydraulically operated pump adapted to be positioned in fluid communication with the fluid source, the pump having a pump chamber and a means for storing potential energy, (b) a conduit connectible to the pump and to a supply of hydraulic fluid positioned remote from the pump, (c) a control means operatively connectible to said conduit to periodically allow pulses of hydraulic fluid to be transmitted into said conduit from said supply of hydraulic fluid to actuate said pump, whereby in use a portion of the energy of each pulse of hydraulic fluid received by the pump is stored as potential energy in said means for storing potential energy and substantially the remainder of the energy actuates said pump to draw fluid from said source into said pump chamber, and during the time between successive pulses the potential energy stored in said means for storing potential energy actuates said pump to pump the fluid from the pump chamber to the predetermined location and to return via the conduit a volume of hydraulic fluid substantially equal to the volume of the preceding pulse of hydraulic fluid to said supply of hydraulic fluid.

It is preferred that the fluid to be pumped and the hydraulic fluid be water, and the supply of hydraulic fluid comprises a water storage tank operably connectible to said conduit. In one arrangement the water flows through the conduit itself to the predetermined location which is adjacent to or forms part of the water storage tank. In an alternative arrangement, a separate water outlet conduit conveys the water from the pump chamber to the predetermined location which is remote from the water storage tank.

Preferably, the pump chamber comprises a pumping element operable to draw water into the pump chamber and to pump water therefrom to the predetermined location, and the pump further comprises a work chamber connectible to the conduit, the work chamber having a work element movable from an equilibrium position in response to changes of pressure in the work chamber caused by pulses of water transferred within said conduit and the work element is operably connected to the pumping element and to the means for storing potential energy.

Preferably, the conduit is operably connectible to the pump chamber, whereby between successive pulses, the potential energy in said means for storing potential energy actuates said pumping element to pump water from said pumping chamber within the said conduit to said predetermined location.

It is preferred that the conduit is operatively connectible to a pumping means, and the control means comprises valve means which in use operably connects the conduit to the water storage tank and to the pumping means, whereby the control means periodically allows pulses of water to be pumped under pressure by the pumping means from the water storage tank within the conduit to the work chamber, and during the time between successive pulses the control means allows flow of water into the water storage tank from the pump chamber together with the volume of water substantially equal to the volume of the preceding pulse of water returning to the water storage tank within the said conduit from the work chamber.

Alternatively, the control means comprises a piston cylinder and piston arrangement, the piston being connectible to a pumping means operable to reciprocate the piston within the piston cylinder to define water delivery and return strokes, the water storage tank being connectible to the conduit at a location between the piston cylinder and the water pump, a one-way valve being positioned to permit water to flow from the conduit into the water storage tank when the pressure within the conduit exceeds a predetermined pressure, whereby in use during a first part of each delivery stroke of the piston forces water is forced within the conduit to increase the pressure within the work chamber to actuate the pump, the first part of the delivery stroke concluding when the pressure within said conduit and the water pump reaches said predetermined pressure at which point the valve opens and during the remainder of the delivery stroke, water flows from the piston cylinder into the water storage tank, and on the return stroke of the piston water is drawn into the piston chamber from the work chamber as the work chamber returns to the equilibrium position and from the pump chamber.

According to the present invention there is also provided a method of pumping fluid from a water source to a predetermined location, the method comprising:

(a) positioning an hydraulically operated pump having a pump chamber and means for storing potential energy, in fluid communication with the water source, (b) periodically transmitting pulses of hydraulic fluid from a supply of hydraulic fluid positioned remote from the pump within a conduit to the pump to actuate the pump and thereby draw fluid into the pump chamber and to store potential energy in the means for storing potential energy, and (c) said means for storing potential energy actuating said pump during the time between successive pulses to thereby pump the fluid in said pump chamber to said predetermined location and to return to said supply of hydraulic fluid via the conduit a volume of hydraulic fluid substantially equal to the volume of the preceding pulse of hydraulic fluid.

According to the present invention there is also provided a method of pumping liquid from a liquid source to a reservoir in a pumping system said system comprising:

a fluid conduit between the reservoir and the source; and pumping means near the source, said method comprising the steps of causing flow of said fluid in the conduit in a direction from said reservoir to said source to accumulate energy in said pumping means for subsequent utilization in a pumping operation of the pumping means in which flow of the fluid in the conduit is in the direction from the source to the reservoir.

According to the present invention there is provided a pump for pumping fluid, said pump comprising:

a pump chamber having a pumping element operable to draw fluid into the pump chamber and to discharge fluid from the pump chamber, a means for storing potential energy operatively connected to said pumping element, a work chamber connectible to a supply of hydraulic fluid, the work chamber having a work element responsive to changes in hydraulic fluid pressure within said work chamber and operatively connected to the pumping element and the means for storing potential energy, whereby in use an increase in hydraulic fluid pressure within said work chamber actuates said work element to cause, simultaneously, an increase in the potential energy in said means for storing potential energy and actuation of said pumping element to draw fluid into the pump chamber, and a subsequent decrease in hydraulic fluid pressure within said work chamber causes said means for storing potential energy to actuate said pumping element to discharge the fluid drawn into the pump chamber.

In one preferred form, the work element comprises a work diaphragm and the pump element comprises a pump diaphragm, the two diaphragms being operatively connected together by a connecting rod, the means for storing potential energy comprises an energy storage chamber containing compressed air, the work chamber and the energy storage chamber being integrally formed and separated by said work diaphragm, whereby increases in hydraulic fluid pressure within said work chamber cause said work diaphragm to distend from an equilibrium position thereby, simultaneously, reducing the volume of said energy storage chamber and increasing the pressure of the compressed air therein and distending said pump diaphragm from an equilibrium position to draw fluid into the pump chamber, and subsequent reduction of pressure within said work chamber causes a pressure imbalance between said work chamber and said energy storage chamber with the result that the work diaphragm returns to its equilibrium position, thereby causing the pump diaphragm to return to its equilibrium position and discharge the volume of fluid drawn into the pump chamber.

In another preferred form, the work element comprises a work piston movable within the work chamber in response to changes in hydraulic fluid pressure within the work chamber and the pump element comprises a pump piston movable within the pump chamber, said work piston and said pump piston being connected together by an interconnecting rod, the rod having a fluid passageway therein arranged to allow a one-way flow of fluid from the pump chamber to the work chamber, whereby in use fluid drawn into the pump chamber is discharged from said pump chamber through the fluid passageway and into said work chamber.

Further detailed description of preferred embodiments of the present invention will now be provided with reference to the accompanying drawings, in which:

FIG. 1*a* is a schematic view of one embodiment of apparatus for pumping water formed in accordance with the present invention;

FIG. 1*b* is a schematic view of an alternative embodiment of apparatus for pumping water formed in accordance with the present invention;

FIGS. 2 to 4 are partially sectional/schematic views illustrating different stages in the operation of one embodiment of the pump formed in accordance with the present invention which is particularly suited for inclusion in the apparatus shown in FIG. 1*a;*

FIG. 5*a* is a sectional view of another embodiment of the pump formed in accordance with the present invention which is also particularly suited for inclusion in the apparatus shown in FIG. 1*a;*

FIG. 5*b* is a sectional view of a modified version of the pump shown in FIG. 5*a*.

FIG. 5c is a sectional view of another embodiment of the pump formed in accordance with the present invention which is also particulary suited for use with the apparatus shown in FIG. 1a.

Figure 1A:
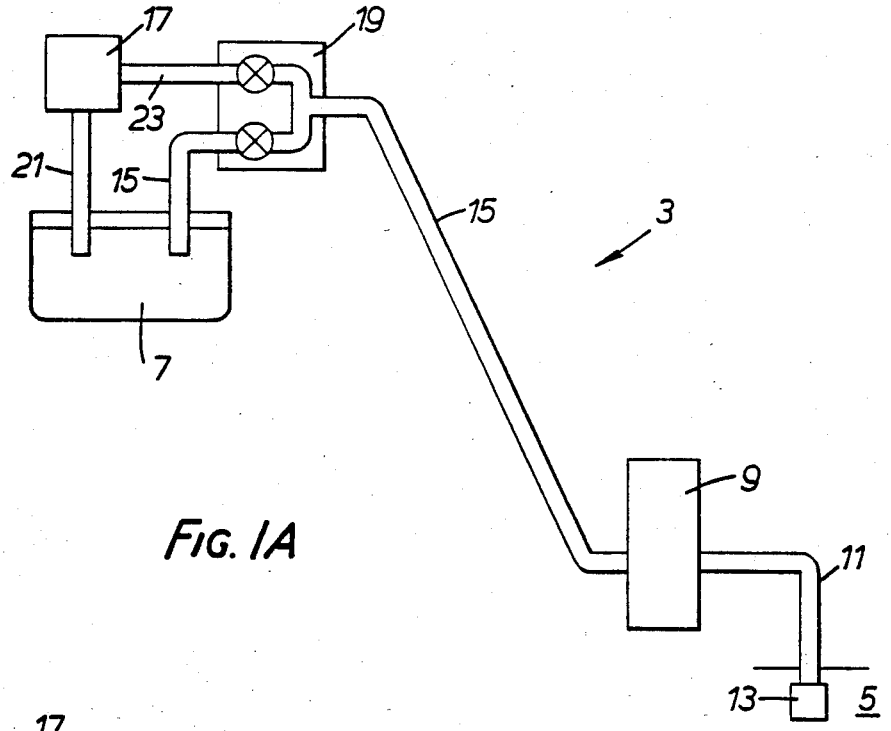

In FIG. 1a is shown an apparatus 3 for pumping water from a reservoir 5 to a water storage tank 7 positioned remote from the reservoir 5.

The apparatus 3 comprises a water pump 9, which acts as a slave pump, positioned in close proximity to the reservoir 5 and in fluid communication therewith by means of a suction conduit 11. A one-way valve 13 is positioned on the end of the conduit 11 located within the reservoir 5 to prevent flow of water from the water pump 9 into the reservoir 5.

The apparatus 3 further comprises a conduit 15 which connects the water pump 9 to the water storage tank 7. A pumping means 17, which acts as an activating pump, is positioned adjacent the water storage tank 7 and is connected by conduits 21 and 23 to the water storage tank 7 and the conduit 15 respectively. In use, the pumping means draws water from the water storage tank 7 and pumps the water down the conduit 15 to the water pump 9.

The apparatus further comprises a control means 19 which is positioned on the conduit 15 to control the flow of water between the water pump 9 and the pumping means 17 and between the water pump 9 and the water storage tank 7.

In use of the apparatus, the control means 19 operates to periodically allow pulses of water to be pumped by the pumping means 17 down conduit 15 to the water pump 9. At the same time the control means 19 prevents flow of water into the water storage tank 7. Each pulse of water pumped down the conduit 15 increases the pressure within the water pump 9, which actuates the water pump 9 to draw water from the reservoir 5 into a pump chamber (not shown) in the water pump 9.

During the time between successive pulses the control means 19 operates to prevent water returning to the pumping means 17 through the conduit 15 and to allow water to flow from the water pump 9 through the conduit 15 into the water storage tank 7. Operation of the control means 19 in this instance results in a reduction in pressure within the conduit 15 and the water pump 9, which actuates the water pump 9 simultaneously:

(a) to force the volume of water drawn in the pump chamber from the reservoir 5 through the conduit 15 to the water storage tank 7, and (b) to return the volume of water delivered into the conduit 15 and water pump 9 by the preceding pulse of water back through the conduit into the water storage tank 7.

It can be appreciated that with the above arrangement, for each unit volume of water forced by the pumping means 17 down the conduit 15 the water pump 9 is actuated to pump two unit volumes of water into the water storage tank 7.

Figure 1B:
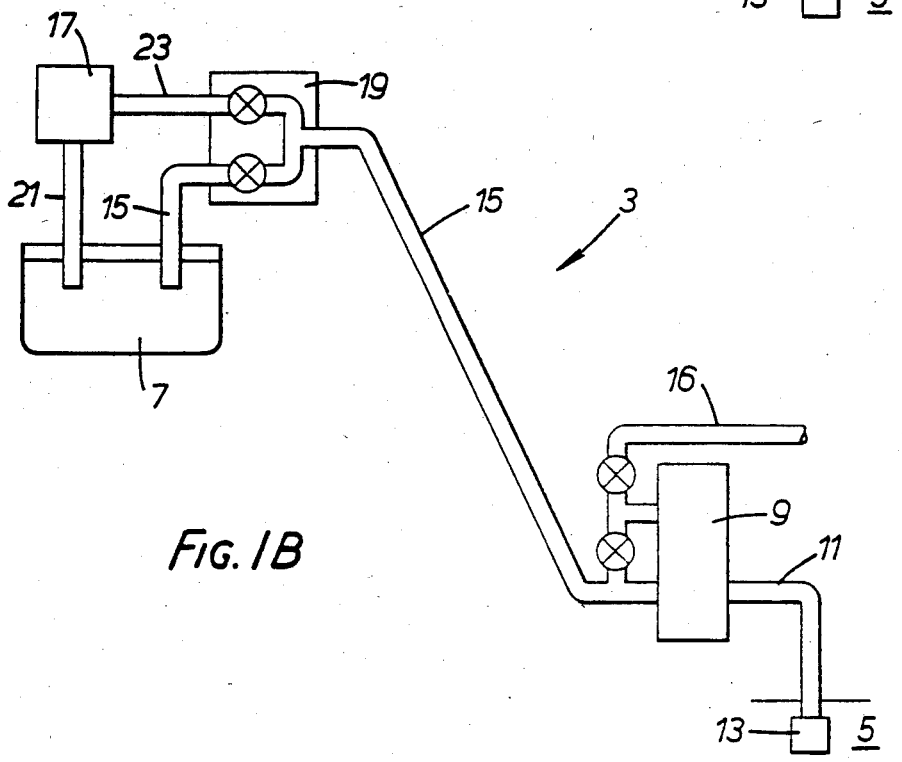

In the embodiment described in FIG. 1a, the conduit 15 has the dual purpose of providing a means by which water can be forced into the water pump 9 to actuate the water pump and also a means by which water drawn from the reservoir 5 into the water pump 9 can be delivered to the water storage tank 7. In an alternative embodiment of the invention shown in FIG. 1b, a separate conduit 16 is connected to the outlet 39 of the pump chamber 34 to deliver the water drawn into the water pump from the reservoir 5 to a predetermined location spaced from the water storage tank 7. In this arrangement the water storage tank 7 functions as a means for storing water to actuate the water pump and the conduit 15 acts as hydraulic energy transfer line only.

The water pump 9 may comprise a water pump formed in accordance with the present invention. One embodiment of a water pump formed in accordance with the present invention is shown in FIG. 2.

Figure 2:
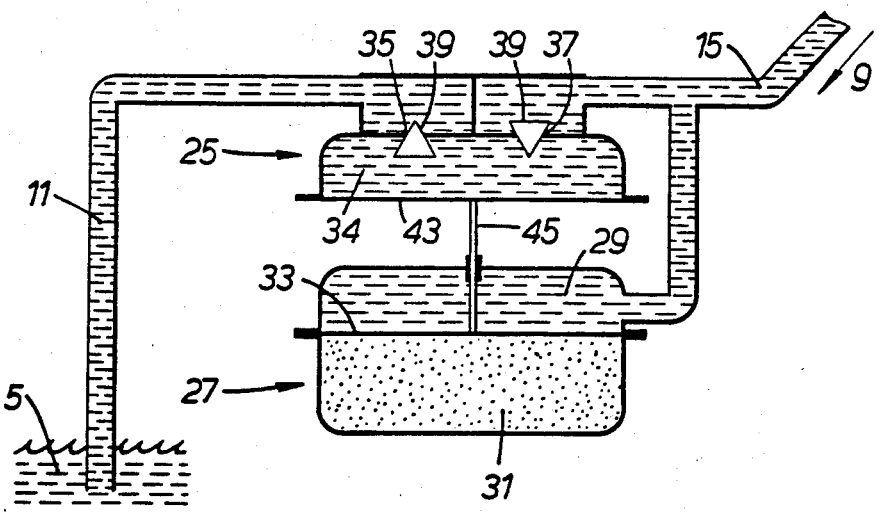

The water pump 9 in FIG. 2 is shown in its equilibrium position and comprises an upper chamber 25 and a lower chamber 27. The lower chamber 27 comprises a work chamber 29 and a potential energy storage means which is in the form of an energy storage chamber 31 containing compressed air. The work chamber 29 and the energy storage chamber 31 are separated by a working element which is in the form of a work diaphragm 33. The work chamber 29 is connected to the conduit 15 and the energy storage chamber 31 is connected to a supply of compressed air which may be introduced into the energy storage chamber through a valve (not shown).

The upper chamber 25 comprises a pump chamber 34 having an inlet 35 connected by the conduit 11 to the reservoir 5 and an outlet 37 connected by the conduit 15 to the water storage tank 7 (not shown). One one-way valves 39 are positioned in the inlet 35 and the outlet 37 to direct a one-way flow of water through the pump chamber 34 from the reservoir 5 and subsequently to the water storage tank 7.

The upper chamber 25 further comprises a pumping element which is in the form of a pump diaphragm 43. The pump diaphragm 43 is connected to the work diaphragm 33 by a connecting rod 45. It can be readily appreciated that movement of the work diaphragm 33 in response to changes of water pressure in the work chamber 29 results in consequential movement of the pump diaphragm 43 in the pump chamber 34.

Figure 3:
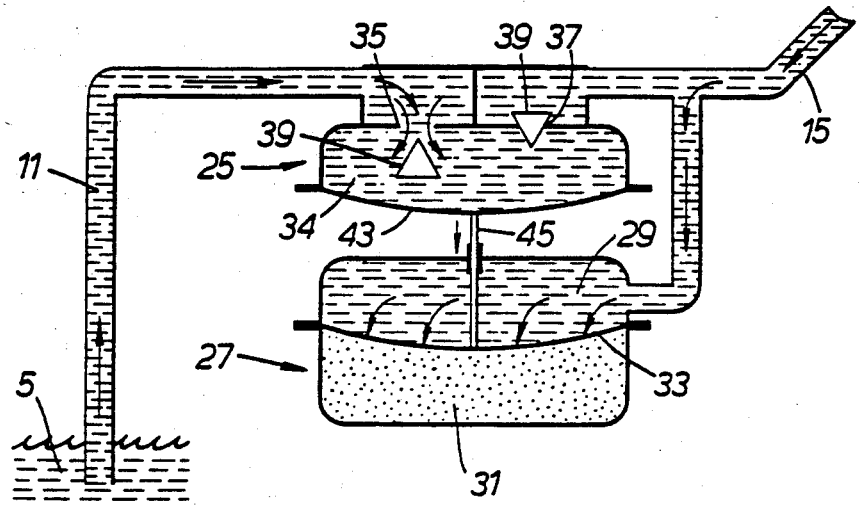

With reference to FIG. 3, when a pulse of water is pumped down the conduit 15, the one-way valve 39 in the water outlet 37 prevents flow of water into the pump chamber 34 and thus the water is directed into the work chamber 29. The pulse of water pumped into the conduit 15 increases the pressure in the work chamber 29 with the effect that work diaphragm 33 distends from the equilibrium position shown in FIG. 2 downwardly into the energy storage chamber 31 thereby causing compression of the volume of compressed air in the energy storage chamber 31. In addition, the downward movement of the work diaphragm 33 causes a consequential downward movement of the pump diaphragm 43 in the pump chamber 34. This results in an increase in volume defined by the pump chamber 34 and causes a suction effect which opens the one-way valve 39 in the inlet 35 and draws water through the conduit 11 from the reservoir 5 into the pump chamber 34.

Figure 4:
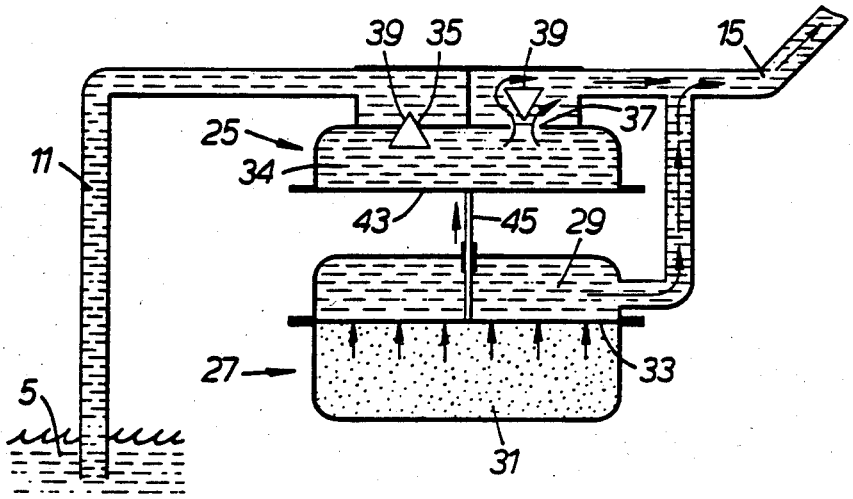

With reference to FIG. 4, when the pulse of water is expended, due to the operation of the control means 19 (FIG. 1a), there is a pressure reduction in the conduit 15 and the work chamber 29. As a result, thee is a pressure imbalance between the work chamber 29 and the energy chamber 31 and to restore equilibrium the compressed air in the energy storage chamber 31 expands and forces the work diaphragm 33 upwardly to the equilibrium position shown in FIG. 2. There is a consequential upward movement of the pump diaphragm 43 in the pump chamber 34 which closes the one-way valve in the inlet 35 and opens the one-way valve 39 in the outlet 37. The combined effect of the upward movement of the work and pump diaphragms 33 and 43 is that water is forced from both the work chamber 29 and the pump chamber 34 into the conduit 15 and subsequently into the water storage tank 7.

Figure 5A:
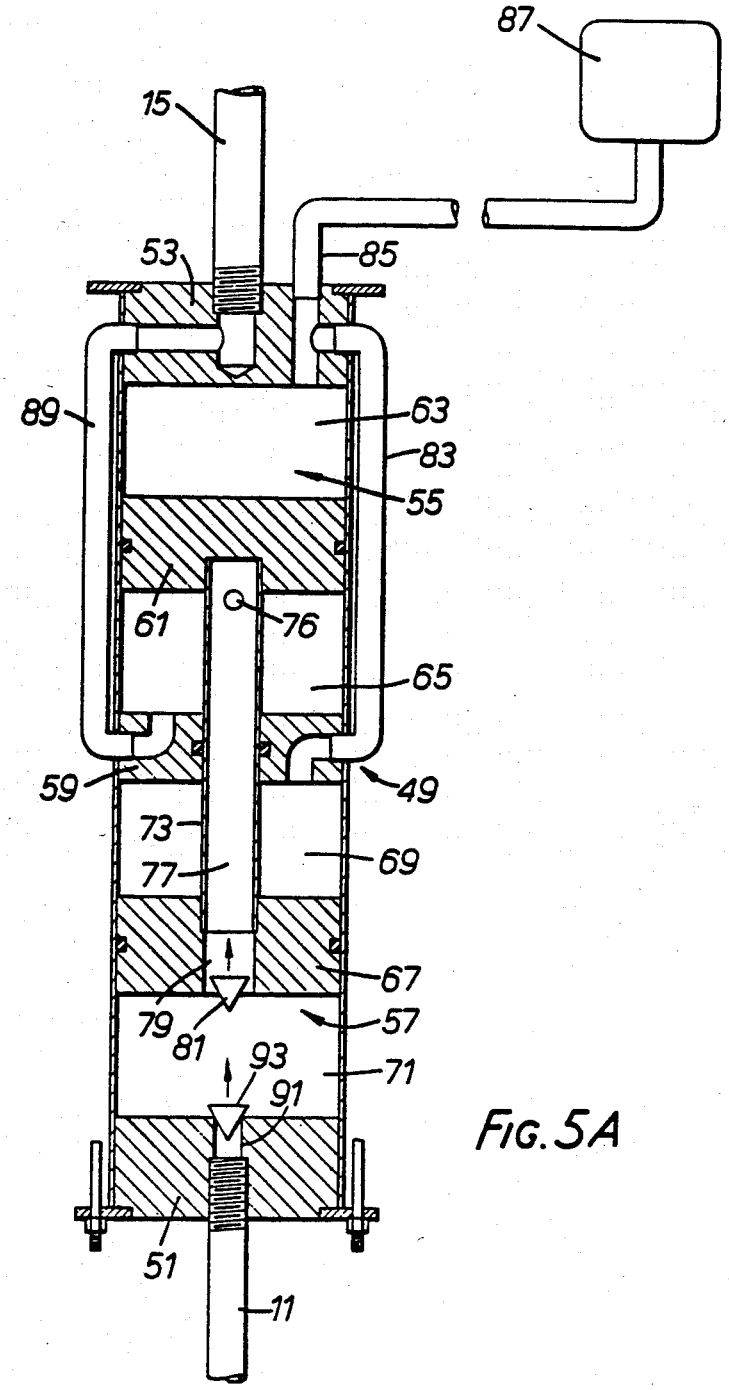

In FIG. 5*a* is shown another embodiment of the water pump formed in accordance with the present invention. The water pump shown in FIG. 5*a*, like the water pump shown in FIGS. 2 to 4, is particularly suited for use with the apparatus for pumping water shown in FIG. 1*a*.

The water pump 9 shown in FIG. 5*a* comprises a cylindrical housing 49 closed by end plates 51 and 53. The cylindrical housing 49 is divided into two chambers 55 and 57 by means of a dividing plate 59. A piston 61 is positioned in chamber 55 and separates the chamber into two chambers 63 and 65. Chamber 65 defines a work chamber and is connected by a conduit 89 to conduit 15. A piston 67 is positioned in chamber 57 and separates the chamber into two chambers 69 and 71. Chamber 71 defines a pump chamber and is connected to suction conduit 11 and water reservoir 5 through an aperture 91 in end plate 51. A one-way valve 93 is positioned in aperture 91 to prevent back flow of water from chamber 71 into the water reservoir 5.

The two pistons 61 and 67 are interconnected by a hollow connecting rod 73 which defines a fluid passageway 77 between the chamber 71 defining the pump chamber and the chamber 65 defining the work chamber. In this connection a port 76 is positioned on the rod 73 adjacent piston 61 to enable flow of fluid between chamber 65 and fluid passageway 77. In addition, the opposite end of the rod 73 is positioned in an aperture 79 in piston 67. The aperture 79 is closed by a one-way valve 81 which permits a one-way flow of fluid from the chamber 71 into the fluid passageway 77.

Chambers 63 and 69 are connected by conduits 83 and 85 to a fluid accumulator 87. The chambers 63, 69 and fluid accumulator 87 define a potential energy storage means and contain substantially incompressible fluid.

In use, a pulse of water forced into conduit 15 from the pumping means 17 shown in FIG. 1*a*, results in water being forced through conduit 89 into chamber 65 defining the work chamber. The one-way valve 81 positioned in the fluid passage-way 77 prevents flow of water into the chamber 71 defining the pump chamber. The increase in the volume of water in the chamber 65 defining the work chamber results in an upward movement (as shown in FIG. 5*a*) of the piston 61 and a consequential upward movement of piston 67. The combined effect is to force fluid within the chambers 63 and 69 into the accumulator 87, under pressure, with the effect that there is an increase in potential energy in the accumulator 87. In addition, the upward movement of the piston 67 causes a suction effect within chamber 71 defining the pump chamber and causes water to be drawn from water reservoir 5 through conduit 11 into the pump chamber.

When the control means 19 shown in FIG. 1*a* terminates the flow of water pumped within conduit 15 and allows water flow into the water storage tank 7 shown in FIG. 1*a* there is a resultant drop in pressure within conduit 15 and chamber 65 defining the work chamber. As a consequence there is a pressure imbalance between respective chambers 63, 65 and 69 and 71, and the accumulator 87 forces downward movement (as shown in FIG. 5*a*) of the pistons 61 and 67 to return to the equilibrium position shown in FIG. 5*a*. The downward movement closes valve 93 and opens the valve 81 in the fluid passageway 77. As can be appreciated from FIG. 5*a*, the net result is that the volume of water drawn into the chamber 71 defining the pump chamber together with the volume increase of water in the chamber 65 defining the work chamber caused by the preceding pulse of water within conduit 15, is forced through conduit 15 into the water storage tank 7 shown in FIG. 1*a*.

In the embodiment shown in FIG. 5*a*, the fluid passageway 77 allows water to flow from the chamber 71 defining the pump chamber to the chamber 65 defining the work chamber. In the modified embodiment shown in FIG. 5*b* the fluid passageway connects the chambers 63 and 69 forming part of the potential energy storage means.

Figure 5B:
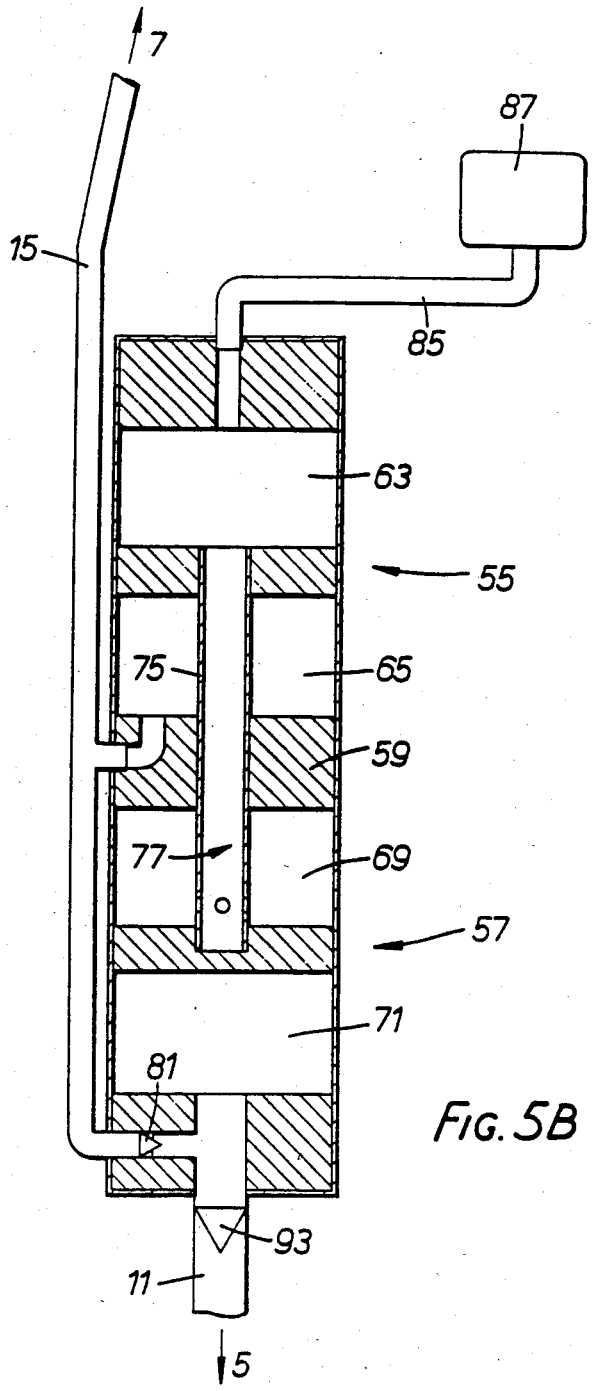

With reference to FIG. 5*b*, the embodiment shown is substantially similar to the embodiment shown in FIG. 5*a* except for the following details. First the connecting rod 73 is secured to the two pistons 61 and 67 so that the fluid passageway connects the chambers 63 and 69 forming part of the potential energy storage means. As a result, it is not necessary to include the conduit 83 connecting the chamber 69 to the fluid accumulator 87 as shown in FIG. 5*a*. Second, the conduit 15 is connected to both the chamber 65 defining the work chamber and to the chamber 71 defining the pump chamber. A one-way valve 81 is positioned to allow flow from the pump chamber into the conduit.

In use of the pump, a pulse of water forced into conduit 15 from the pumping means 17 shown in FIG. 1*a*, results in water being forced into the chamber 65 defining the work chamber. The one-way valve 81 prevents flow of water through conduit 15 into the chamber 71 defining the pump chamber.

The overall result is an increase in volume of water into the chamber 65 defining the work chamber which causes an upward movement (as shown in FIG. 5*b*) of the piston 61 and a consequential upward movement of piston 67. The combined effect of the movement of the pistons is to force fluid from chambers 63 and 69 into the accumulator 87, under pressure, thereby increasing the potential energy stored in the accumulator. In addition the upward movement of the piston 67 causes water to be drawn from the water reservoir 5 through conduit 11 into the chamber 71 defining the pump chamber.

When the control means 19 shown in FIG. 1*a* terminates the flow of water pumped within conduit 15 and allows water flow into the water storage tank 7 shown in FIG. 1*a*, there is a resultant drop in pressure within conduit 15 and chamber 65 defining the work chamber. As a consequence, there is a pressure imbalance between respective chambers 63,65 and 69,71, and the accumulator 87 forces downward movement of the pistons 61 and 67 to return to the equilibrium position shown in FIG. 5*b*. The downward movement closes the valve 93 and thus prevents return flow of water from the chamber 71 defining the pump chamber into the reservoir 5. However, valve 81 opens and the volume of water drawn into the pump chamber is forced into the conduit 15, and together with the volume of water forced into the chamber 65 defining the work chamber during the preceding pulse, flows through conduit 15 to the water storage tank 7 shown in FIG. 1*a*.

Figure 5C:
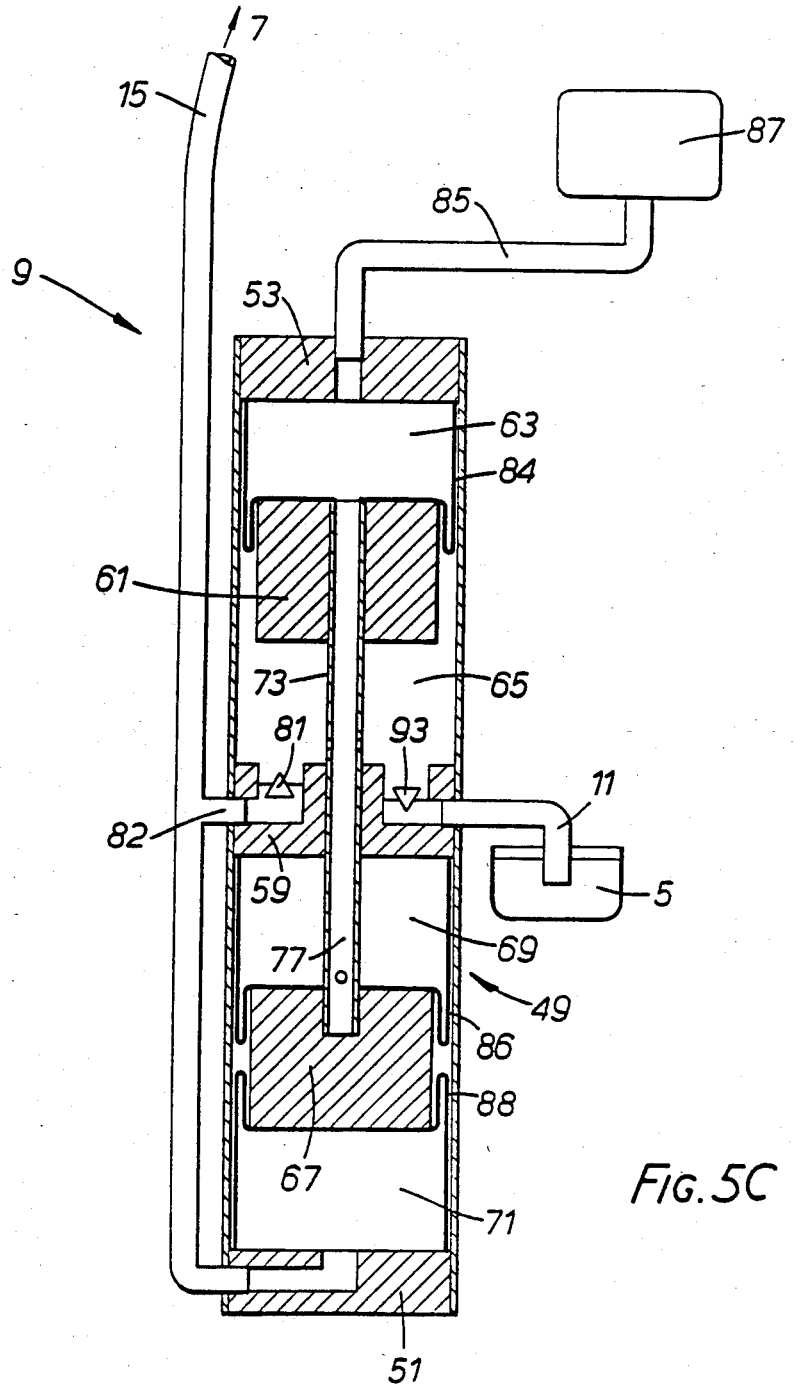

A further embodiment of a water pump formed in accordance with the present invention is shown in FIG. 5c. The water pump shown in FIG. 5c, like the water pumps shown in FIGS. 2 to 4, 5a and 5b, is particularly suited for use with the apparatus for pumping water shown in FIG. 1a.

The water pump 9 shown in FIG. 5c is similar to the water pumps shown in FIGS. 5a and 5b in that it comprises a cylindrical housing 49 closed by end plates 51 and 53. In addition, the cylindrical housing 49 is divided into an upper and a lower chamber by a dividing plate 59.

A piston 67 is positioned in the lower chamber and separates the chamber into two separate chambers 69 and 71. Chamber 71 defines a work chamber and is connected to conduit 15. A piston 61 is positioned in the upper chamber and separates the chamber into two separate chambers 63 and 65. Chamber 65 defines a pump chamber and is connected by means of conduit 11 to water reservoir 5. A valve 93 positioned in conduit 11 allows a one-way flow only of water from reservoir 5 through conduit 11 into chamber 65 defining the pump chamber. In addition, a conduit 82 connects the chamber 65 to the conduit 15 and valve 81 positioned in the conduit 82 allows one-way flow only of water from the chamber 65 defining the pump chamber into conduit 15 and ultimately into the water storage tank 7, as shown in FIG. 1a.

The two pistons 61 and 67 are interconnected by a hollow connecting rod 73 which defines a fluid passage way 77 between chambers 63 and 69. As can be clearly seen in FIG. 5c, a conduit 85 connects the chambers 63 and 69 to a fluid accumulator 87, and together the three components define a potential energy storage means.

The water pump 9 further comprises roller diaphragms 84, 86 and 88 positioned as shown in FIG. 5c to effectively seal the separate chambers within the upper and lower chambers respectively.

In use of the water pump 9, a pulse of water forced into conduit 15 from the pumping means shown in FIG. 1a results in water being forced into chamber 71 defining the work chamber. The one-way valve 81 prevents flow of water through conduits 15 and 82 into the chamber 65 defining the pump chamber. The overall result is an upward movement (as shown in FIG. 5c) of the piston 67 with consequential upward movement of the piston 61 together with consquential movement of the roller diaphragms 84, 86 and 88. The combined effect of the movement of the pistons is to force fluid from the chambers 63 and 69 into the accumulator 87, thereby increasing the potential energy stored in the accumulator 87. In addition, upward movement of the piston 61 causes expansion of the chamber 65 defining the pump chamber with the effect that water is drawn from the reservoir 5 into the pump chamber.

When the control means 19 shown in FIG. 1a terminates the flow of water pumped within conduit 15 and allows water flow into the water storage tank 7 shown in FIG. 1a, there is a resultant drop in pressure within conduit 15 and chamber 71 defining the work chamber. As a consequence, there is a pressure imbalance within the lower chamber and the accumulator 87 returns fluid to the chambers 63 and 69 to force the pistons 61 and 67 downwardly to the equilibrium position shown in FIG. 5c. The downward movement closes valve 93 in the chamber 65 defining the pump chamber and thus prevents water flow from the pump chamber into reservoir 5. However, valve 81 opens and the volume of water previously drawn into the pump chamber is forced into the conduit 15, and together with the volume of water forced from the chamber 71 defining the work chamber, due to downward movement of piston 67, flows through conduit 15 to the water storage tank 7 shown in FIG. 1a.

The principal difference between the water pumps shown in FIGS. 5a and 5b and the water pump 9 shown in FIG. 5c, is the use of roller diaphragms 84, 86 and 88 to improve the seal between the separate chambers within the upper and lower chambers respectively. One important consequence is that the tolerances between the walls of the pistons 61, 67 and the inner wall of the cylindrical housing 49 are not as critical as is the case with arrangements which do not use roller diaphragms. This is a particularly important advantage in situations where the pump is used for pumping bore water, since mineralisation of working parts in the pump can reduce the efficiency of the pump. In addition, to improve the effectiveness of the roller diaphragms it has been found preferable to reverse the position of the work and pump chambers. Thus, it is noted that the chamber 65 defines the pump chamber, whereas the chamber 71 defines the work chamber.

Figure 6:
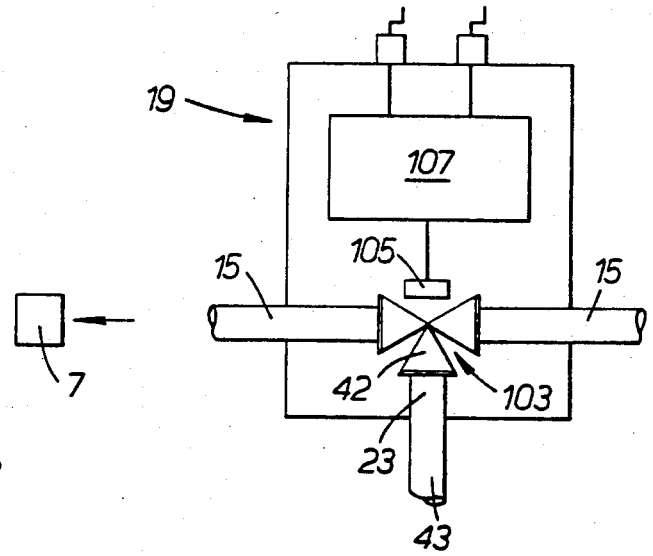
FIG. 6 is a schematic view of one embodiment of the control means shown in FIG. 1.

A particular embodiment of the control means 19 shown in FIG. 1a will now be described with reference to FIG. 6. The control means 19 comprises a three-way valve 103 operated by an electric solenoid 105. The control means 19 operates in the following manner:

1. When the solenoid 105 is energised the three-way valve 103 operates to allow flow of water from the pumping means 17 through conduits 23 and 15 into the water pump 9. At the same time, the three-way valve 103 prevents flow of water into the water storage tank 7.

2. When the solenoid 105 is de-energized the three-way valve 103 operates to allow flow of water from the water pump 9 through conduit 15 into the water storage tank 7. At the same time, the three-way valve 103 prevents flow of water from the water pump 9 into the pumping means 17.

The control means further comprises electric circuitry 107 for controlling the energizing and de-energizing of the solenoid 105 to operate the three-way valve 103 to periodically allow pulses of water from the pumping means 17 into the water pump 9 and return flow of water from the water pump 9 into the water storage tank 7.

The electronic circuitry operates in the following manner:

1. The electronic circuitry energizes the solenoid 105 for a sufficient time to allow a preselected volume of water to flow from the pumping means 17 through conduits 23 and 15 to the pumping means.

2. The electronic circuitry then de-energizes the solenoid 105 for a sufficient time to allow the water forced from water pump 9 to pass through the three-way valve 103 to the water storage tank 7.

The embodiment of control means 19 described above is particularly suitable for use with conventional household "constant pressure" pumping systems.

Figure 7:
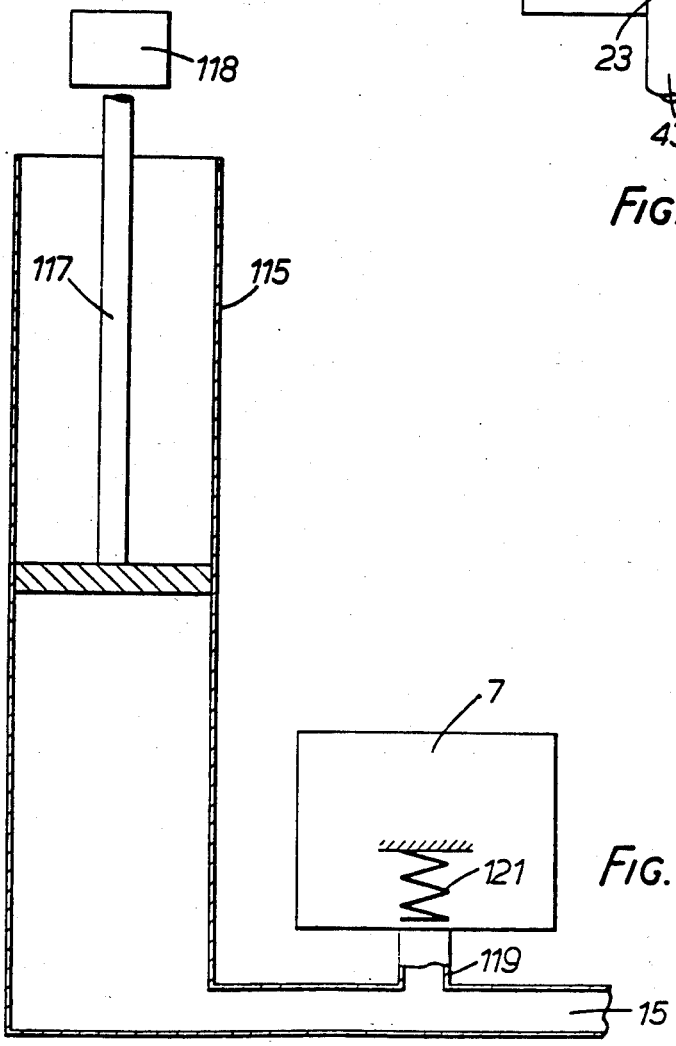
FIG. 7 is a schematic view of another embodiment of the control means shown in FIG. 1.

A second embodiment of the control means 19 which is particularly suited for use with pumping means 17 in the form of a windmill is shown in FIG. 7. The control means 19 comprises a piston cylinder 115 and piston 117. The piston 117 is coupled to a windmill 118 (or any other suitable power means) to reciprocate the piston 117 within the cylinder 115. The piston cylinder 115 is connected at its lower end to conduit 15 and a branch conduit 119 connects the conduit 15 to the water storage tank 7. A spring loaded valve arrangement 121 is positioned on the conduit 119 to close the valve and prevent flow of water through the conduit 119 into the water storage tank 7.

In use, for a part of the water delivery stroke of the piston 117 water flows within conduit 15 to actuate the water pump 9. The arrangement is such that the part of the delivery stroke delivers a sufficient volume of water to fully actuate the work element in the working chamber of the water pump 9.

During the remainder of the water delivery stroke the increase in pressure within conduit 15 is sufficient to open the spring loaded valve arrangement 121 to allow the volume of water delivered by the remainder of the water delivery stroke to flow through conduit 119 into the water storage tank 7.

On the return stroke of the piston 117 the piston cylinder 115 is recharged by:

(a) the volume of water corresponding to the volume of water delivered by the first part of the water delivery stroke, and (b) the additional water drawn into the pump chamber of the water pump 9 from the reservoir 5.

It can be readily appreciated that although the present invention has been described in relation to use in agriculture, the invention is not so limited, and could be used in a number of applications, including general applications in medical and industrial fields.

I claim:

1. A pumping system for pumping fluid, said system comprising:

a pump chamber having a pumping element operable to draw fluid into the pump chamber and to discharge fluid from the pump chamber, means for storing potential energy operatively associated with said pumping element, a work chamber connectible to a supply of hydraulic fluid, the work chamber having a work element responsive to changes in hydraulic fluid pressure within said work chamber and operatively connected to the pumping element and the means for storing potential energy, whereby in use an increase in hydraulic fluid pressure within said work chamber actuates said work element to cause, simultaneously, an increase in the potential energy in said means for storing potential energy and actuation of said pumping element to draw fluid into the pump chamber, and a subsequent decrease in hydraulic fluid pressure within said work chamber causes said means for storing potential energy to actuate said pumping element to discharge the fluid drawn into the pump chamber, wherein the means for storing potential energy comprises a fluid accumulator and first and second potential energy storage chambers; the work element comprises a work piston separating the work chamber from the first potential energy storage chamber, the work piston being movable in response to changes of hydraulic fluid pressure within said work chamber; the pumping element comprises a pump piston separating the pump chamber from the second potential energy storage chamber; an interconnecting rod connecting the work piston and the pump piston together whereby the pump piston is movable in response to movement of the work piston, the interconnecting rod defining a fluid passageway connecting the first and second potential energy chambers.

2. A pumping system according to claim 1, wherein the fluid accumulator is remote from the first and second potential energy storage chambers and is connected thereto by means of a conduit.

3. A pumping system comprising an actuating pump, a slave pump having a piston assembly for drawing liquid from a liquid source, a pipeline connecting the actuating pump to the slave pump, and a hydraulic accumulator associated with the slave pump, said actuating pump being operable to supply a volume of liquid along said pipeline to said slave pump in order to drive a piston assembly of said slave pump and to store potential energy in the hydraulic accumulator, the energy stored in said accumulator thereafter releasing in order to drive the piston assembly of the slave pump so as to deliver a volume of liquid greater than that supplied by the actuating pump, wherein the slave pump comprises a cylinder having end walls and an intermediate wall, the piston assembly of the slave pump comprises two pistons and a hollow piston rod interconnecting the pistons for movement within the cylinder, said pistons being on respective sides of the intermediate wall and said pistons defining, with the intermediate and end walls of the cylinder, a work chamber connected to the pipeline to receive the actuating volume of liquid, a pump chamber having inlet means into which liquid is drawn when the interconnected pistons are displaced, means connecting the pump chamber to the pipeline for delivery of the liquid, and first and second accumulator chambers interconnected via the piston rod and connected to the hydraulic accumulator whereby during the delivery stroke, the pressure in the hydraulic accumulator acts on two piston faces of the piston assembly, the first and second accumulator chambers being at opposite sides of the intermediate wall, with the first accumulator chamber being adjacent the intermediate wall and the second accumulator chamber being adjacent the end wall remote from the first accumulator chamber, and the work chamber and the pump chamber being at opposite sides of the intermediate wall and each adjacent a respective one of the two accumulator chambers, one from the work chamber and pump chamber being adjacent the intermediate wall on the side thereof opposite the first accumulator chamber and the other from the work chamber and pump chamber being adjacent the end wall remote from the second accumulator chamber.

4. A pumping system comprising an actuating pump, a slave pump having a piston assembly for drawing liquid from a liquid source, a pipeline connecting the actuating pump to the slave pump, and a hydraulic accumulator associated with the slave pump, said actuating pump being operable to supply a volume of liquid along said pipeline to said slave pump in order to drive a piston assembly of said slave pump and to store potential energy in the hydraulic accumulator, the energy stored in said accumulator thereafter releasing in order to drive the piston assembly of the slave pump so as to deliver a volume of liquid greater than that supplied by the actuating pump, wherein the slave pump comprises a cylinder having end walls and an intermediate wall, the piston assembly of the slave pump comprises two pistons interconnected for movement within the cylinder, said pistons being on respective sides of the intermediate wall and said pistons defining, with the intermediate and end walls of the cylinder, a work chamber connected to the pipeline to receive the actuating volume of liquid, a pump chamber having inlet means into which liquid is drawn when the interconnected pistons are displaced, means connecting the pump chamber to the pipeline for delivery of the liquid, and first and second interconnected accumulator chambers connected to the hydraulic accumulator whereby during the delivery stroke, the pressure in the hydraulic accumulator acts on two piston faces of the piston assembly, the first and second accumulator chambers being at opposite sides of the intermediate wall, with the first accumulator chamber being adjacent the intermediate wall and the second accumulator chamber being adjacent the end wall remote from the first accumulator chamber, and the work chamber and the pump chamber being at opposite sides of the intermediate wall and each adjacent a respective one of the two accumulator chambers, one from the work chamber and pump chamber being adjacent the intermediate wall on the side thereof opposite the first accumulator chamber and the other from the work chamber and pump chamber being adjacent the end wall remote from the second accumulator chamber, said accumulator being remote from the slave pump, and a conduit connecting the said two accumulator chambers to the accumulator.

* * * * *